United States Patent [19]

Burton et al.

[11] Patent Number: 5,003,450

[45] Date of Patent: Mar. 26, 1991

[54] PORTABLE LIGHT FIXTURE WITH CORD SPOOL

[76] Inventors: John C. Burton, 323 W. Burnett St., Long Beach, Calif. 90806; J. Brian Carter, 4520 Clinton St., Los Angeles, Calif. 90026

[21] Appl. No.: 503,525

[22] Filed: Apr. 2, 1990

[51] Int. Cl.[5] ..... F21S 1/12

[52] U.S. Cl. ..... 362/387; 362/258

[58] Field of Search ..... 362/387, 157, 258; 242/77; 248/329

[56] References Cited

U.S. PATENT DOCUMENTS

| | | | |
|---|---|---|---|
| 1,281,162 | 10/1918 | Holloway | 362/258 |
| 1,392,441 | 10/1921 | Nikonow | 362/258 |
| 2,070,561 | 2/1937 | Cantor | 362/387 |
| 2,079,532 | 5/1937 | Sheppard | 362/387 |
| 2,591,131 | 4/1952 | Brus | 362/258 |
| 2,938,110 | 5/1960 | Busch et al. | 362/258 |
| 3,014,123 | 12/1961 | Mainzer | 362/258 |
| 3,322,944 | 5/1967 | Mellyn | 362/258 |
| 3,378,681 | 4/1968 | Meyer et al. | 362/387 |
| 3,439,159 | 4/1969 | McRoskey et al. | 362/258 |
| 3,823,384 | 7/1974 | Messmer et al. | 362/387 |
| 4,241,385 | 12/1980 | Asano | 362/258 |

*Primary Examiner*—James C. Yeung

*Attorney, Agent, or Firm*—Stetina and Brunda

[57] ABSTRACT

An improved portable light fixture is disclosed which is specifically adapted to be hand-held and utilized for emergency applications, particularly with respect to motor vehicles. The fixture comprises a conical-shaped lens which is rotatably mounted to a cylindrical housing. Disposed within the interior of the housing is a spool which is rigidly attached on one end of the lens and on the other end to a plate disposed on the bottom of the housing, such that the lens, spool, and bottom plate will rotate in unison. The spool further includes a winding of electrical wire, one end of which is connected to a conventional light bulb disposed beneath the lens and the opposite of which includes a connector which may be inserted into a cigarette lighter of an automobile, or alternatively connected by way of alligator clips to the main terminal of an automobile.

4 Claims, 1 Drawing Sheet

Fig. 1
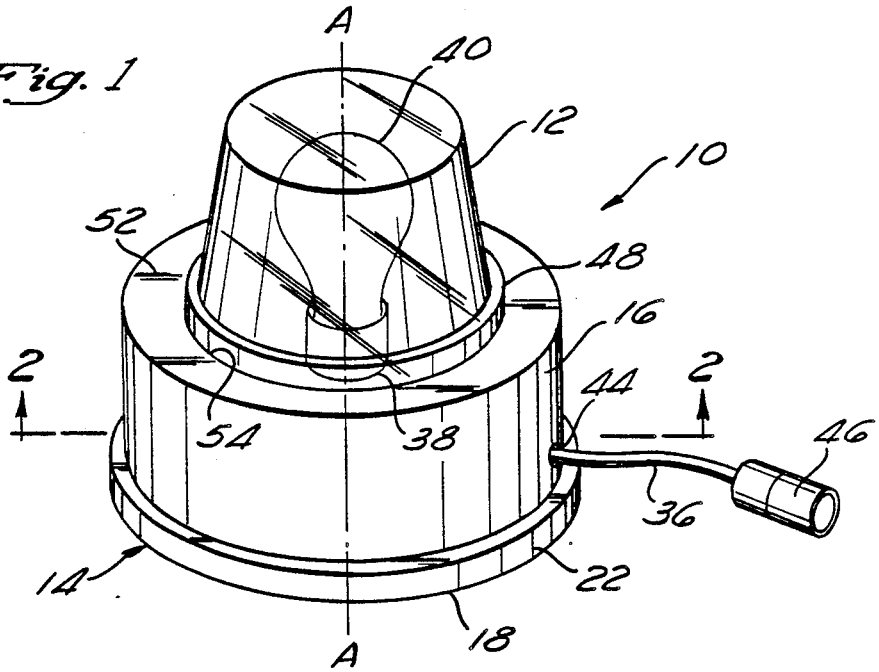
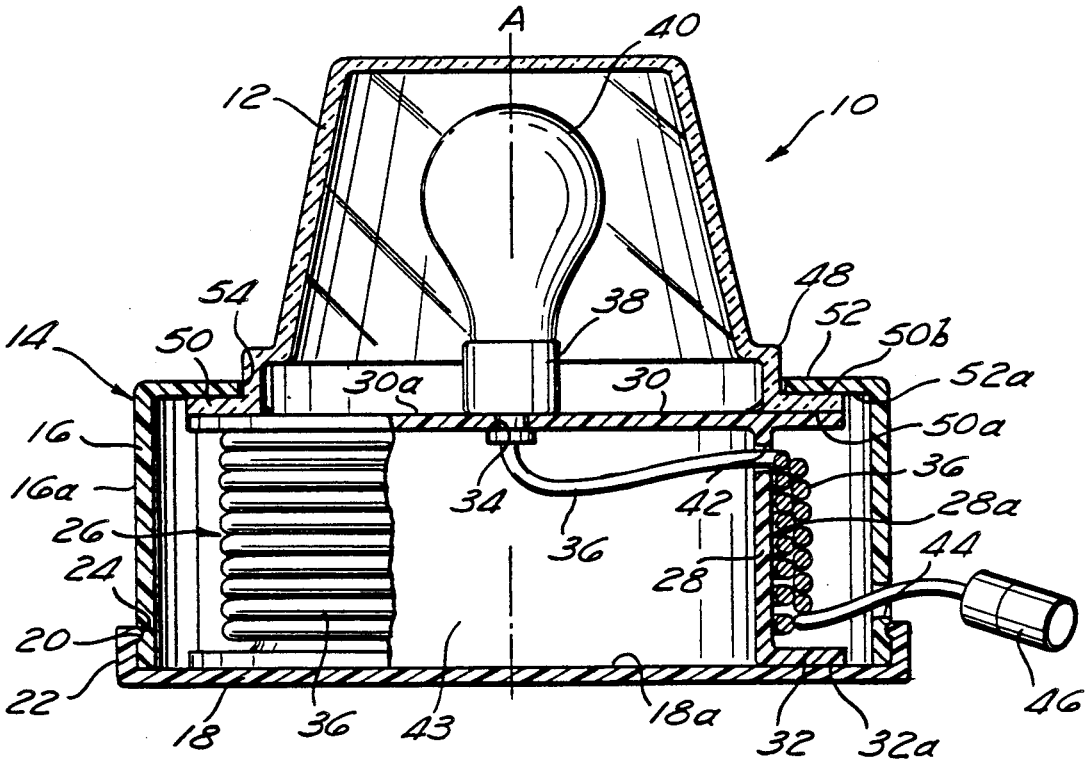
Fig. 2

PORTABLE LIGHT FIXTURE WITH CORD SPOOL

FIELD OF THE INVENTION

The present invention relates generally to a light fixture, and more particularly to an improved hand-held portable light fixture, for use in emergency applications, particularly with respect to motor vehicles. The invention is characterized by a lens rotatably mounted to a housing having a spool which is disposed within the housing rigidly attached thereto, wherein the spool includes a winding of electrical wire which may be rapidly deployed and affixed to a power source associated with an automobile.

BACKGROUND OF THE PRESENT INVENTION

As is well known, mishaps involving automobiles traveling on highways is a frequent and common occurrence. Typically, such mishaps include flat tires, engine failure, and in some instances, vehicular collisions. Particular difficulty as well as danger is encountered when such mishaps occur at night. In these instances, oftentimes a driver finds that his vehicle is not equipped with a flashlight or other light source. The need for such a light source as a means of performing vehicular maintenance and/or providing a warning for other approaching vehicles is extremely important from a safety standpoint, particularly when considering the inherent risks associated with vehicles which are disabled on or near roadways. It is important that the vehicle, in these situations, be equipped with a light source that is both quickly deployable and has a power source associated with the vehicle itself, due to the relatively short life span of conventionally-known household batteries. A number of devices for providing such a light source are disclosed in U.S. Pat. Nos. 1,281,162 to Holloway; 1,392,441 to Nikonow; 3,322,944 to Mellyn; and 3,439,159 to McRoskey et al. However, the light sources disclosed by these references are limited due to their ability to focus a beam of light in only one direction such as is done with oonventionally-known flashlights. In this respect, such limited unidirectional capacitY diminishes the ability of the light source to serve as an emergency beacon for traffic approaching the disabled vehicle in a direction opposite of the light beam. Although U.S. Pat. No. 2,938,110 to Busch et al. eliminates this particular problem, the device disclosed in this reference does not lend itself to compact efficient storage nor rapid deployment. The present invention overcomes many of these difficulties by providing a compact and easily stored hand-held portable light source which can be rapidly deployed and which can radiate light in all directions.

SUMMARY OF THE INVENTION

In accordance With a preferred embodiment of the present invention, there is provided a compact, portable light fixture with a winding spool which is specifically adapted to be handled and utilized for emergency applications, such as in motor vehicles. The device generally comprises a conical-shaped lens which is rotatably mounted about its center line to a cylindrical housing. The interior of the housing includes a spool which is rigidly attached to the lens on one end and to a bottom plate on the other end such that when the lens is grasped by the user and rotated about its center line, the spool and bottom plate rotate in unison therewith. The spool includes a winding of electrical wires, one end of which is connected to a conventional light bulb disposed beneath the lens and the opposite end of which includes a connector which may be inserted into a cigarette lighter of an automobile or alternatively connected as by way of alligator clips to the main battery terminal of the automobile.

Upon encountering an emergency condition a user may rapidly attach the connector to the cigarette lighter or battery terminals of the vehicle and unwind by rotation of the lens a desired length of electrical wire from the spool. When the emergency condition has passed, the user may simply disconnect the connector from the cigarette lighter or battery terminals and subsequently rotate the lens to cause the wire to be stored upon the spool.

An object of the present invention is to provide a hand-held portable light fixture for use in emergency applications, particularly with respect to automobiles.

Another object of the present invention is to provide a portable light fixture having a spool including a winding of electrical wire which can be rapidly deployed and rewound.

Another object of the present invention is to provide a portable light fixture which can radiate a beam of light in all directions.

A further object of the present invention is to provide a portable light fixture wherein the rewinding of the wire about the spool is accomplished by rotating the lens of the device.

A still further object of the present invention is to provide a portable light fixture which derives its power from the battery of the automobile.

A still further object of the present invention is to provide a portable light fixture which is compact and easy to store within the automobile.

BRIEF DESCRIPTION OF THE DRAWINGS

These as well as other features of the present invention will become more apparent upon reference to the drawings wherein:

FIG. 1 is a perspective view of a preferred embodiment of the present invention; and FIG. 2 is a cross-sectional view of the present invention taken along line 2—2 of FIG. 1.

DETAILED DESCRIPTION OF THE PREFERRED EMBODIMENT

Referring now to the drawings wherein the showings are for purposes of illustrating a preferred embodiment of the present invention only and not for purposes of limiting the same, FIG. 1 shows a portable light fixture 10 which is generally comprised of a conical-shaped lens 12 rotatably mounted about a center line A—A to a generally cylindrical housing 14. In the preferred embodiment of the present invention, housing 14 is molded or otherwise formed from a suitable plastic material. As best seen in FIG. 2, housing 14 is comprised of two separate components, namely an upper tubular portion 16 and a lower circular bottom plate 18 which is rotatably attached to tubular portion 16. Disposed within the outer surface **16*a* of tubular portion 16, about the circumference of the lower end thereof, is a groove 20. The upper end of tubular portion !6 further includes an inwardly-turned extension 52 which defines a circular opening 54 therein. With respect to the structure of bottom plate 18, disposed about the periphery of bottom plate 18 is an upwardly extending flange 22**.

Extending horizontally about the inner diameter of flange 22 is a lip 24. With regard to the assembly of housing 14, the attachment of bottom plate !8 to tubular portion 16 is facilitated by the receipt of lip 24 into groove 20 such that bottom plate 18 may be rotated with respect to tubular portion 16.

Referring now to FIG. 2, rotatably mounted within housing !4 is a spool 26. Spool 26 is preferably of molded plastic construction and has as a primary component a center annular member 28. Extending outwardly from the bottom end of annular member 28 is a rim 32. The upper end of annular member 28 includes a circular surface 30 which is molded thereon. Disposed Within circular surface 30 along center lines A—A is an aperture 34. Importantly, the outer diameter of circular surface 30 is equal to and vertically aligned with the outer diameter of rim 32. Thus, according to the construction of spool 26, the outer surface **28*a* of annular member 28 is bordered on one end by circular surface 30 and on the other end by rim 32. With regard to the securing of spool 26 within housing 14, lower surface 32*a* of rim 32 is rigidly attached to top face 18*a* of bottom plate 18. Thus, when bottom plate 18 is attached to tubular portion !6, spool 26 is secured within housing In the preferred embodiment of the present invention, a length of wire 36 is wound about the outer surface 28*a* of annular member 28. Wire 36 is maintained on surface 28*a* by rim 32 and circular surface 30. One end of wire 36 passes from outer surface 28*a* through an opening 42 which is disposed within annular member 28, into the hollow interior 43 of annular member 28. From the interior 43 of annular member 28, wire 36 passes through aperture 34 of circular surface 30 and terminates into a conventionally known electrical socket 38. Socket 38 is attached to upper face 30*a* of circular surface 30 and is disposed above aperture 34 along center line A—A. A light bulb 40 is contained within socket 38. The end of wire 36 which is opposite of that affixed to socket 38 passes from outer surface 28*a* to the exterior of housing 14 through a hole 44 which is disposed within tubular portion 16. This end of wire 36 terminates into an adapter 46** which is receivable into a cigarette lighter of an automobile (not shown).

Lens 12 of the present invention is preferably made of a translucent red material in order to properly serve as a safety signal under hazardous conditions. Lens 12 is conically shaped having an open end and includes an undulating edge 48 which extends about the periphery of the open end as best seen in FIG. 2. Undulating edge 48 terminates into an outwardly extending flange 50. Importantly, lens 12 is specifically sized and configured to be grasped in the hand of a user. Lower surface **50*a* of flange 50 is rigidly attached to upper face 30*a* of circular surface 30 thus cooperatively engaging lens 12 with spool 26. In this respect, manual rotation of lens 12 by the hand of a user will impart corresponding rotational movement to spool 26. This rotation, depending upon its direction, will cause the paying in or paying out of wire 36 from the interior of housing 14 as it is wound and unwound from outer surface 28*a* of spool 28. Lens 12 is disposed within circular opening 54 of tubular portion 16 such that upper surface 50*b* of flange 50 is abutted against interior surface 52*a* of extension 52. This abutment forms bearing surfaces during rotation of lens 12 thus allowing for the rotational movement of lens 12 while maintaining spool 26 within housing 14**.

Additional modifications and improvements of the invention may also be apparent to those skilled in the art, thus, the particular combination of parts described and illustrated herein is intended to represent only one embodiment of the invention, and is not intended to serve as limitations of alternative devices within the spirit and scope of the invention.

What is claimed is:

1. A portable light fixture comprising:

a generally cylindrical housing comprising an upper tubular portion having first and second ends, said first end including an inwardly-turned lip having an interior surface wherein said lip defines a generally circular opening therein and said second end including a bottom plate attached thereto;

a spool disposed within said housing;

a light mounted to said spool;

a length of conducting material windable about said spool having first and second ends, said first end being electrically connected to said light, said second end having means for electrically connecting said conducting material to a power source external of said housing; and a conically-shaped lens having an open end, said open end including an outwardly extending flange defining upper and lower surfaces disposed about the periphery thereof, said lens being sized and configured to be grasped in the hand of a user and be manually rotated to impart corresponding rotational movement of said spool to pay in and pay out said conducting material from said housing, said lens being disposed within said generally circular opening such that said upper surface of said flange abuts said interior surface of said lip thereby forming bearing surfaces during rotation of said lens.

2. A portable light fixture, as defined in claim 1, wherein said spool is comprised of an annular member having a top end and a bottom end, said bottom end terminating in an outwardly extending rim and said top end having a generally circular surface associated therewith, said conducting material being disposed about said annular member and maintained thereon by said rim and said circular surface.

3. A portable light fixture as defined in claim 2, wherein said lower surface of said flange is secured to said circular surface.

4. A portable light fixture comprising:

a generally cylindrical housing comprising an upper tubular portion having first and second ends, said first end including an inwardly-turned lip having an interior surface wherein said lip defines a generally circular opening therein and said second end including a bottom plate attached thereto;

a spool disposed within said housing;

a light mounted to said spool;

a length of conducting material windably about said spool having first and second ends, said first end being electrically connected to said light, said second end having means for electrically connecting said conducting material to a power source external of said housing; and a lens having an open end, said open end including an outwardly extending flange defining upper and lower surfaces disposed about the periphery thereof, said lens being sized and configured to be grasped in the hand of a user and be manually rotated to impart corresponding rotational movement of said spool to pay in and pay out said conducting material from said housing, said lens being disposed within said generally circular opening such that said upper surface of said flange abuts said interior surface of said lip thereby forming bearing surfaces during rotation of said lens.

* * * * *